United States Patent [19]

Milne

[11] 4,268,833

[45] May 19, 1981

[54] BROADBAND SHAPED BEAM ANTENNA EMPLOYING A CAVITY BACKED SPIRAL RADIATOR

[75] Inventor: Robert Milne, Ottawa, Canada

[73] Assignee: Her Majesty the Queen in right of Canada, as represented by the Minister of National Defence, Ottawa, Canada

[21] Appl. No.: 69,212

[22] Filed: Aug. 23, 1979

[30] Foreign Application Priority Data

Sep. 8, 1978 [CA] Canada ..... 310920

[51] Int. Cl.[3] ..... H01Q 1/36

[52] U.S. Cl. ..... 343/833; 343/895

[58] Field of Search ..... 343/789, 833, 845, 895

[56] References Cited

U.S. PATENT DOCUMENTS

| | | | |
|---|---|---|---|
| 3,152,330 | 10/1964 | Chatelain | 343/895 |
| 3,205,498 | 9/1965 | Child | 343/705 |
| 3,820,117 | 6/1974 | Hall et al. | 343/895 |

*Primary Examiner*—Eli Lieberman

*Attorney, Agent, or Firm*—Alan H. Levine

[57] ABSTRACT

An antenna for use in navigation and communication satellite systems, which has a hemispheric response pattern. The antenna is constructed of a pair of conductors formed into a planar spiral and backed by a cavity. Radial elements extend orthogonal to the spiral axis outwardly around the periphery of the spiral. A crossed pair of parasitic elements is located above and coplanar to the spiral plane.

11 Claims, 2 Drawing Figures

BROADBAND SHAPED BEAM ANTENNA EMPLOYING A CAVITY BACKED SPIRAL RADIATOR

BACKGROUND OF THE INVENTION

This invention relates to an antenna which is particularly useful for the reception of signals transmitted from an orbiting satellite of the earth.

Satellites used in navigational and communication systems normally transmit signals to be received by airplanes, ships, or land vehicles. As the satellite location relative to the airplanes, ship and vehicles generally constantly varies, and can be located at any angle from horizon to horizon, the receiving antennas must have a fairly constant gain over $2\pi$ steradians. Accordingly, the receiving pattern should be hemispheric.

Further, such antennas must be small and be able to be streamlined in order that they should not affect the aerodynamic characteristics of an aircraft on which they may be mounted.

It is desirable that the antenna should be able to be standardized for use on various surfaces, whether such surfaces provide a large or small ground plane with the same or predictable gain. It is also desirable that the antenna be broadband for reception of signals at various widely dispersed frequencies.

In the past, antennas which were to be used in such systems were directional and required steering, and hence were highly complex and costly, or had a cardioid, rather than hemispheric response. The cardioid response pattern has a deteriorating gain characteristic as the angle of reception reduces toward the horizon. This is opposite to the required effect since at low angles of reception, the signal weakens because of increased atmospheric attenuations and free space path loss.

The present invention is an antenna which has a low profile and thus has a very small or negligible aerodynamic effect on an airplane on which it may be mounted. Further, the antenna may be mounted on a ground plane of various sizes with little change in performance. The antenna has a hemispheric response pattern, which is ideal for use in communications and navigational satellite systems, while being relatively broadband.

SUMMARY OF THE INVENTION

The inventive antenna, in general, is comprised of a first receiving element comprising a pair of conductors wound in a planar spiral, and a conductively walled cylindrical cavity disposed below the spiral having an opening facing the spiral. The diameter of the cavity is similar to the outer diameter of the spiral of conductors. A plurality of radial elements extend outwardly relative to and in a plane parallel to and below the spiral conductors, orthogonol to the axis of the spiral. Parasitic element means is located in a plane which is orthogonal to the axis of the spiral, above the spiral conductors.

The spiral is wound in a single plane, and the parasitic element means is comprised of a pair of narrow crossed conductors.

BRIEF INTRODUCTION TO THE DRAWINGS

A better understanding of the invention will be obtained by reference to the detailed description below, and to the following drawings, in which.

DETAILED DESCRIPTION OF THE INVENTION

Figure 1:
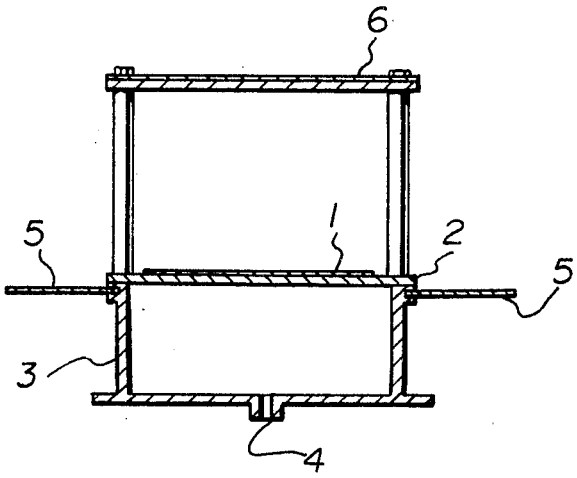
FIG. 1 is a cross-sectional elevation view of the antenna.

Considering both drawings together, a pair of conductors is wound in a spiral 1. Preferably the conductors are formed of etched copper on the surface of a Fiberglas TM circuit board base 2. A cylindrical, conductive cavity 3 is disposed below the spiral 1, having one side open, facing the spiral. The other end of the cylindrical cavity is closed, except for a small opening to accommodate a transmission line.

A plurality of radial elements 5 are disposed around the periphery of the spiral, extending orthogonal to the axis of the spiral. The elements may be fastened to an upper lip of the cavity for convenience, since normally the cavity wall is part of the antenna ground system.

Parasitic element means 6, preferably a crossed pair of conductors, is disposed above the spiral, in a plane orthogonal to the axis of the spiral. Preferably the spiral is wound in a single plane, being disposed on a flat Fiberglas surface, and the crossed pair of conductors on the parasitic element means should be located in a plane parallel to the plane of the spiral. Preferably, the crossed pair of conductors is also etched from copper on a Fiberglas circuit board base.

While no specific form of construction is shown, eight radial elements 5 are screwed into tapped holes in the lip or flange of the cavity 3 in one embodiment. While 8 radial elements were found to be optimum, of course, more than 8 radial elements can be used. The base 2 carrying the spiral of conductors can be fastened with screws around the outside of the spiral to the top of the flange or lip of cavity 3, and the base for the parasitic elements can be screwed to polystyrene or other insulating standoff posts 7 extending to, and held by screws to the aforenoted flange of the cavity. As an alternative, a thin-walled fiberglass tube can be used in place of the standoff insulating posts 7 with no change in performance.

The crossed conductors forming the parasitic elements should be of length as to have an inductive impedance at the lowest frequency of operation, i.e., greater than $\frac{1}{2}$ wavelength. The radial elements should also be of such length as to have an inductive impedance at the lowest frequency of operation, i.e., greater than $\frac{1}{4}$ wavelength.

It is believed that the intercepted signals received from the parasitic elements combine with the signals in the spiral conductors to shape the elevation pattern of the antenna. It is also believed that the signals induced in the radial elements combine with the signals from the spiral conductors to also shape the elevation pattern. The resulting elevation pattern has been found to be hemispheric.

Figure 2:
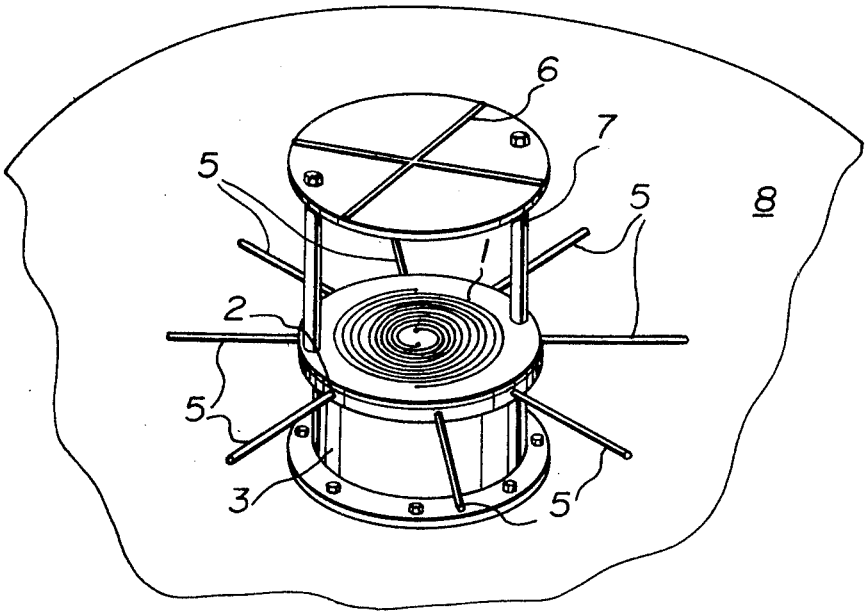
FIG. 2 is a perspective view of the inventive antenna.

FIG. 2 shows the antenna mounted on a conductive ground plane 8.

During testing of the antenna, measurements showed that there was no significant change in the hemispheric response when the ground plane was 18″ in diameter and 60″ in diameter, although there was an expected rise in sidelobe level with the 18″ diameter ground plane. It is believed that the antenna patterns improve as the ground plane increases in diameter, by which the sidelobe level decreases.

As an example of the antenna for the use at 1.575 GHz and 1.227 GHz, the dimensions of the antenna were as follows. The inside diameter of the cavity was 5.5", and its depth was 2.1". Each radial element was 3.00" long, and the crossed conductors forming the parasitic elements were 6" long, located 4.8" from the spiral. The spiral was a photo-etched 17 turn spiral of 5.5" nominal diameter in copper.

Holes were drilled at the centre of the spiral for the attachment of terminals for a transmission line which passed through hole 4.

The resulting beamwidth over a nominal $2\pi$ steradian solid angle was hemispheric, as will be noted below. The instantaneous radio frequency bandwidth was 25%, with a voltage standing wave ratio of less than 1.5:1. The elevation patterns were symmetrical about the central axis of the antenna, and were almost independent of azimuth angle.

With operation at 1.575 GHz, the circularly polarized gain was greater than 0 dbi between 0° (Zenith) and 80° elevation. The gain at 85° elevation was −1.5 dbi, and at 90° (horizon) was −4.5 dbi.

At 1.227 GHz, the circularly polarized gain was greater than 0 dbi between 0° (Zenith) and 72° elevation, −3.5 dbi at 80° elevation, −5.5 dbi at 85°, and −8.0 dbi at 90° elevation (horizon).

This response is clearly virtually hemispheric. In addition, the small structure allows aerodynamic shaping of the antenna, which is particularly useful for aircraft applications.

A person skilled in the art understanding this invention may now conceive of various modifications, or other embodiments. All are considered within the sphere and scope of this invention as defined in the appended claims.

I claim:

1. An antenna comprising:

(a) a first receiving element comprised of a pair of conductors wound in a spiral, (b) a conductively walled cylindrical cavity disposed below the spiral having an opening facing the spiral, the diameter of the cavity being similar to the outer diameter of the spiral of conductors, (c) a plurality of radial elements extending outwardly relative to and in a plane parallel to and below the spiral conductors, orthogonal to the axis of the spiral, and (d) parasitic element means located parallel with and above the plane of the spiral conductors.

2. An antenna as defined in claim 1 in which the spiral is wound in a single plane, and the parasitic element means is comprised of a pair of narrow crossed conductors.

3. An antenna as defined in claim 2, in which the length of each of the parasitic elements is greater than about $\frac{1}{2}$ wavelength.

4. An antenna as defined in claim 2, in which the length of each of the radial elements is greater than about $\frac{1}{4}$ wavelength.

5. An antenna as defined in claim 2, further including a ground plane located immediately behind the cavity.

6. An antenna as defined in claim 3, in which the length of each of the radial elements is greater than about $\frac{1}{4}$ wavelength.

7. An antenna as defined in claim 4, 5 or 6, in which the outer diameter of the cavity is about 6 inches, and the diameter of the ground plane is at least about 18".

8. An antenna as defined in claim 6, in which the spiral is comprised of 17 turns of said conductors, the outer diameter thereof being about $5\frac{1}{2}$".

9. An antenna as defined in claim 7, in which the cavity has an inner diameter of about $5\frac{1}{2}$" and a depth of about 2.1" and the parasitic elements are located about 4.8 inches above the spiral.

10. An antenna as defined in claim 2, 6 or 8, including terminal means for the antenna connected to the most inward extremities of the conductors of the spiral.

11. An antenna as defined in claim 8 in which the length of each of the parasitic elements is about 6 inches.

* * * * *